United States Patent [19]

Beringer et al.

[11] 3,934,594

[45] Jan. 27, 1976

[54] PROCESS FOR THE MANUFACTURE OF TOBACCO SUBSTITUTE

[75] Inventors: Monique Béringer, Saint Louis, France; Paul Buchmann, Basel, Switzerland

[73] Assignee: Tamag Basel AG, Switzerland

[22] Filed: Aug. 1, 1974

[21] Appl. No.: 493,884

Related U.S. Application Data

[63] Continuation of Ser. No. 337,479, March 2, 1973, abandoned.

[30] Foreign Application Priority Data

Mar. 2, 1972 Luxemburg ..... 64889

[52] U.S. Cl. ..... 131/2

[51] Int. Cl.[2] ..... A24B 15/00; A24D 1/18

[58] Field of Search ..... 131/2, 15, 17, 140–144

[56] References Cited

UNITED STATES PATENTS

| | | | |
|---|---|---|---|
| 2,576,021 | 11/1951 | Koree | 131/2 |
| 3,003,895 | 10/1961 | Grunwald | 131/17 |
| 3,125,098 | 3/1964 | Osborne | 131/140 C |
| 3,240,214 | 3/1966 | Bavley et al. | 131/141 |
| 3,280,823 | 10/1966 | Bavley et al. | 131/17 UX |
| 3,369,552 | 2/1968 | Carroll | 131/2 |
| 3,429,316 | 2/1969 | Hess | 131/17 R |
| 3,545,448 | 12/1970 | Mormon | 131/2 |
| 3,608,560 | 9/1971 | Briskin et al. | 131/2 |
| 3,729,009 | 4/1973 | Stevens et al. | 131/2 |

FOREIGN PATENTS OR APPLICATIONS

| | | | |
|---|---|---|---|
| 908,439 | 10/1962 | United Kingdom | 131/17 |
| 1,113,979 | 5/1968 | United Kingdom | 131/2 |

*Primary Examiner*—Robert W. Michell
*Assistant Examiner*—V. Millin
*Attorney, Agent, or Firm*—Wenderoth, Lind & Ponack

[57] ABSTRACT

The present invention provides a homogeneous nicotine-free tobacco substitute which consists of:

5,000 grams of filler consisting of: one or more of gramineous plants or shells of nuts, cocoa beans or coffee beans,
600 grams magnesium formate
50 grams tartaric acid
300 grams potassium nitrate
1,000 grams paraffinurea
300 grams diammonium hydrogen phosphate
10 grams vanillylidenurea
1,500 grams sodium carboxymethylcellulose
1,4000 grams glycerine
150 grams diethylene glycol
1,050 grams fruit concentrate
600 grams raw molasses
105 grams malt extract.

4 Claims, No Drawings

PROCESS FOR THE MANUFACTURE OF TOBACCO SUBSTITUTE

This is a continuation of application Ser. No. 337,479, filed Mar. 2, 1973, now abandoned.

In the manufacture of tobacco substitute, one endeavours to make the substitute as similar as possible to natural tobacco with regard to elasticity, ability to be cut and tensile strength, so that it can be processed technologically like tobacco. Furthermore, the tobacco substitute should be capable of burning away and its smoke should be mild, and in particular irritant, acrid and bitter flavour components should be avoided. Nicotine and other disadvantageous or harmful substances can be avoided a priori through the selection of the starting materials — non-tobacco plants and additives.

Using known manufacturing processes, a tobacco substitute can be manufactured which only partly fulfils the prerequisites just mentioned and it has been found that favourable aromatic and flavour characteristics, that is to say a mild, pleasant, non-irritant, characteristic smoke must be procured through additional expense which must be incurred in the procurement of the starting materials, since costly starting materials are used.

It is the task of the invention to design a process of the initially mentioned nature so that a tobacco substitute having the abovementioned properties is obtainable, using waste products which are available in large amount and also in sufficiently constant quality.

The invention is characterised in that, in order to manufacture the paste, the following constituents are comminuted, stirred into water and homogenised:

Firstly, a filler constituent which consists of one or more of the following filler components: wheat chaff, oat chaff, chaff of other types of gramineous plants, wheat straw, oat straw and of other types of gramineous plants, wheat bran, oat bran, bran of other types of gramineous plants, coffee bean shells, coconut shells, coconut fibres, cocoa bean shells and fibres, as well as shells of other types of nuts;

secondly, an active substance constituent which consists of several of the following active substance components: fruit concentrate, raw molasses, caramel and malt extract, in particular in an amount which suffices, including the contents of all other constituents of the paste, to give a total content, of the total constituents of the paste, of at least 1 percent by dry weight of aminoacids and of at least 5 percent by dry weight of sugars;

thirdly, a nitrogen donor constituent which consists of several of the nitrogen donor components potassium nitrate, urea and diammonium hydrogen phosphate and in particular in an amount which suffices, including the contents of all other constituents of the paste, to give a total content, of the total constituents of the paste, of at least 3 percent by dry weight of nitrogen, without taking the aminoacids into account;

fourthly, a structure-forming constituent which consists of one or more of the structure-forming components sodium carboxymethylcellulose (NaCMC) and other cellulose derivatives and raw pectin and fifthly, a special active substance constituent which consists of one or more of the following special active substances: plasticisers, flavour-improving and odour-improving agents, agents for improving burning characteristics, and dyestuff; per 100 parts by dry weight of filler constituent, 10 to 45 parts by dry weight of active substance constituent, 10 to 45 parts by dry weight of nitrogen donor constituent, 10 to 60 parts by dry weight of structure-forming constituent and 20 to 90 parts by dry weight of special active substance constituent are present.

Preferably, 17 to 25 parts by dry weight of active substance constituent, 12 to 26 parts by dry weight of nitrogen donor constituent, 27 to 33 parts by dry weight of structure-forming constituent and 48 to 62 parts by dry weight of special active substance constituent are present per 100 parts by dry weight of filler constituent.

By coffee bean shells there are meant the natural sheaths of the coffee beans, also referred to as coffee bean pods.

The paste constituents, which fulfil different tasks, are preferably mixtures of several different components in order to avoid the peculiarities of a single component standing out in the smoke and causing the unpleasant after-taste which is characteristic of numerous known tobacco substitutes.

The descriptions "filler component" , "active substance component" , "nitrogen donor component" , "structure-forming component" and "special active substance" relate to the main effect of these components of the paste, which of course does not exclude components from having, alongside their main effect, an entirely desirable side-effect which supplements the main effect of another component. For example, the coconut shell filler component produces a smooth chocolate aroma suggestion in the smoke, that is to say a flavour effect which is a side effect of the coconut shell, alongside the filler effect. Preferably, if two otherwise equivalent components are available, those whereof the side effects assist the main effect desired from other constituents of the paste are preferred. For example, a flavour component which at the same time is a nitrogen donor will be preferred over an otherwise equivalent flavour component which is not a nitrogen donor.

According to the invention, most of the constituents of the paste are raw substances, in contrast to chemically pure substances. The raw substances are preferably natural products or by-products which arise when the former are processed. This is, on the one hand, important for economic reasons because chemically pure substances are more expensive than raw substances, but on the other hand is of considerable advantage for the desired aromatic properties since it has been found that penetrating flavour nuances of individual substances have a considerably less disadvantageous effect in the smoke if these substances are not used in a chemically pure form but in the raw form. The question of what mechanisms are responsible for this favourable effect has not yet been investigated but presumably acrid flavour nuances of the chemically pure substances are adapted by the "impurities" or by the cell connections which are still present in the raw substances, or they are masked in the aroma.

It is noteworthy that according to the invention paste constituents which contain relatively little cellulose are used. It is furthermore noteworthy that using the invention a tobacco substitute can be manufactured which is of extraordinarily durable suppleness so that the tobacco substitute and the product manufactured therefrom which can be smoked can be stored for a very long time without suffering, on storage, substantial deteriorations in their quality, which frequently has to be tolerated when storing natural tobacco products.

It is preferred that the filler constituent and the active substance constituent should consist exclusively of foodstuff wastes from the industrial manufacture of foodstuffs and should together account for at least 50 percent by dry weight of the paste constituents. Amongst the foodstuff wastes which are available, those fractions which meet the desired properties particularly well, will preferably be used for the manufacture of the tobacco substitute.

A filler constituent which contains the following filler components: wheat chaff, coconut shells and cocoa bean shells, in particular preferably in the dry weight ratio of approx. 4.2 : 0.5 : 0.3, is preferred.

Various effects are sought by means of the active substance component and for the reasons explained above it is desirable to provide at least three different active substance components for each of these desired effects, namely making up the sugar content, making up the amino-acid content, plasticising the tobacco substitute and dyeing the tobacco substitute, it being entirely possible for one and the same active substance component to participate in several different effects, as is, for example, the case for fruit concentrate which acts as a sugar donor, as an aminoacid donor, as a structure-forming agent and, in many cases, also as a plasticiser.

The making up of the sugar content and of the aminoacid content by means of the active substance constituent, and the making up of the nitrogen content by the nitrogen donor constituent, serves to ensure that the contents mentioned are approximately of the same order of magnitude in the tobacco substitute as in the natural tobacco. These contents are particularly high in natural tobacco as compared to non-tobacco plants and it has been found that these contents carry an important share of the responsibility for the particular properties of natural tobacco which is why they are also, according to the invention, made up in the tobacco substitute.

The structure-forming constituent serves to impart the necessary strength to the tobacco substitute and preferably only consists of NaCMC.

A preferred special active substance constituent consists of one or more of the special active substance components: paraffinurea, divanillylideneurea, vanillylideneurea, tartaric acid, glycerine, diethylene glycol, magnesium formate, potassium nitrate and calcium carbonate. The paraffinurea mentioned is an addition compound of liquid paraffin with urea, for example an addition compound in which 8 molecules of urea are present per one paraffin molecule containing 10 carbon atoms. The special active substance components paraffinurea, divanillylideneurea, vanillylideneurea and tartaric acid, have the effect of improving the flavour and improving the odour whilst the components glycerine and diethylene glycol act as plasticisers, that is to say make the tobacco substitute hygroscopic. The components magnesium formate, potassium nitrate and calcium carbonate improve the burning characteristics and are thus responsible for uniform smouldering and for a white ash.

A particular flavour nuance can be achieved by stirring natural tobacco extract into the paste as a flavour-assisting and aroma-assisting special active substance component.

In the manufacture of the paste, which is then shaped, for example in the form of sheets, filaments, fibres, flocks, ribbons and the like, to produce the tobacco substitute, water is required for making up and then has to be evaporated again in part, with expenditure of energy, in order to consolidate the tobacco substitute. The use of little water saves energy during evaporation but makes it more difficult to manufacture a homogeneous paste and to shape the latter to give the tobacco substitute. A process which manages with very little water when manufacturing the paste is characterised in that, using water and the filler constituents in the dry weight ratio of 4 : 1 to 2 : 1, preferably 2 : 1, a suspension is formed, which is then ground wet, and that then the remaining constituents of the paste are mixed in and the resulting paste is homogenised by kneading and is then shaped and consolidated, by subsequent drying, to give the material which can be smoked. Kneading can be carried out, for example, with kneaders or with a roll mill, as is known and customary in the manufacture of ointments, creams and the like in the pharmaceutical and cosmetic industry. The shaping can also be effected by means of such a roll mill.

If a fairly large proportion of water is used for the manufacture of the paste, milling can be dispensed with and the requisite homogeneity can be achieved by stirrers alone. An embodiment of this type of the process according to the invention is characterised in that using water and paste constituents in the dry weight ratio of 6 : 1 to 4 : 1, preferably 4 : 1, a suspension is first formed from the filler constituents which have been ground dry and from about half the water, the suspension is then ground wet and the remaining constituents of the paste are then stirred in whilst adding the second half of the water.

In addition to the manufacturing process, the invention also relates to a tobacco substitute consisting of the paste constituents of the shaped paste which are not volatile during drying for the purpose of consolidation, and of residual water.

Examples of the individual components of the mixture are given below. These components are classified under the individual constituents according to their main effect, and where there is an important side-effect the latter is mentioned in brackets after the component in question. Components which are preferred either for economic reasons or because of their particular effect are described as preferred components, whilst other components which are not as advantageous but are also entirely usable, are described as usable components.

Preferred components for the filler constituent are chaff (latin: Palea), bran (latin: Furfur) and straw of wheat, oats and rice, cocoa bean shells and coconut shells (all of them also acting as structure-forming agents).

Examples of usable components for the filler constituent are chaff, straw and bran of barley, rye, maize, flax and other types of gramineous plants and coffee bean shells (all of them also acting as structure-forming agents).

Preferred components for the active substance constituent are fruit concentrate as a sugar donor and plasticiser (structure-forming agent and flavour-improving agent), raw molasses as a sugar donor and nitrogen donor (plasticiser, aminoacid donor and colouring agent), caramel as a sugar donor (colouring agent) and malt extract as a nitrogen donor and sugar donor (plasticiser and colouring agent). The fruit concentrate consists of the fruit residues which arise in the manufacture of fruit juice.

Preferred components for the nitrogen donor constituent are potassium nitrate (which improves the burning characteristics), divanillylideneurea and diammonium hydrogen phosphate.

Examples of usable components for the nitrogen donor constituent are glycine, vanillylideneurea, betaine, ammonia and other ammonium compounds.

Preferred components for the structure-forming constituent are raw pectin and NaCMC.

Examples of usable components for the structure-forming constituent are pectin, methylcellulose and other cellulose derivatives, as well as cellulose fibres.

Preferred plasticiser components for the special active substance constituent are glycerine and diethylene glycol.

Examples of usable plasticiser components for the special active substance constituent are 70 percent strength sorbitol and mixtures of sorbitol and glycerine.

Preferred flavour-improving or aroma-favouring components for the special active substance constituent are paraffinurea, vanillylideneurea, divanillylideneurea (nitrogen donors), tartaric acid, liquid paraffin and Flavor (sic).

An example of a usable flavour-improving and aroma-favouring component for the special active substance constituent is the residue containing caffeine as obtained in the manufacture of caffeine-free soluble coffee powder (nitrogen donor and aminoacid donor).

Preferred components which improve the burning characteristics, for the special active substance constituent, are magnesium formate, potassium nitrate (nitrogen donor) and calcium carbonate (filler).

Preferred dyestuff components for the special active substance constituent are natural tobacco extract, active charcoal, caramel and coffee grounds.

EXAMPLE 1

2,000 grams of wheat chaff, 2,000 grams of oat chaff, 500 grams of coconut shells and 500 grams of cocoa bean shells are ground dry and suspended in 30 liters of water, and the suspension is ground wet at a temperature between 45° and 55° centrigrade.

600 grams of magnesium formate, 150 grams of tartaric acid, 300 grams of potassium nitrate, 690 grams of urea, 300 grams of diammonium hydrogen phosphate and 7.5 grams of vanillin, in powder form, are stirred into 30 liters of water until all has dissolved. 450 grams of asbestos, 600 grams of calcium carbonate, 300 grams of liquid paraffin, 1,125 grams of NaCMC and 50 grams of pectin are stirred into this solution, whilst stirring vigorously (sic). The solution is stirred vigorously for about 5 minutes and is then left to stand for 30 minutes, being stirred briefly every 5 minutes. Thereafter 75 grams of glyoxal are poured in whilst stirring.

The abovementioned suspension is then stirred into the solution thus produced and a paste forms, into which 1,350 grams of glycerine, 150 grams of diethylene glycol, 1,000 grams of fruit concentrate, 600 grams of raw molasses, 100 grams of caramel and 150 grams of malt extract are then stirred.

The paste is spread on a continuous belt and consolidated by drying to give a tobacco substitute sheet.

It is of importance that after the fruit concentrate has been added the paste should be further processed rapidly and promptly to give the tobacco substitute, in order to avoid fermentation.

According to this example, approx. 20 parts by dry weight of active substance constituent, approx. 26 parts by dry weight of nitrogen donor constituent, approx. 30 parts by dry weight of structure-forming constituent and approx. 60 parts by dry weight of special active substance constituent are present per 100 parts by dry weight of filler constituent.

EXAMPLE 2

1,000 grams of wheat bran, 1,000 grams of wheat straw, 1,000 grams of rice chaff, 1,000 grams of oat straw, 500 grams of coconut shells with fibres and 500 grams of cocoa bean shells are ground dry and suspended in 30 liters of water, and the suspension is ground wet at a maximum temperature of 60° centigrade.

The following components are introduced into the suspension thus produced: 500 grams of magnesium formate, 300 grams of tartaric acid, 100 grams of potassium nitrate, 500 grams of urea, 400 grams of diammonium hydrogen phosphate, 7.5 grams of vanillin, 450 grams of asbestos, 400 grams of calcium carbonate, 450 grams of liquid paraffin, 900 grams of NaCMC, 200 grams of raw pectin, 150 grams of glyoxal, 800 grams of glycerine, 650 grams of diethylene glycol, 850 grams of fruit concentrate, 1,000 grams of raw molasses, 100 grams of active charcoal, 200 grams of malt extract and 50 grams of coffee bean residue, and the mixture is then kneaded in a roll mill to give a homogeneous paste which is then shaped by milling to give a sheet which is consolidated by drying.

According to this example approx. 24 parts by dry weight of active substance constituent, approx. 20 parts by dry weight of nitrogen donor constituent, approx. 30 parts by dry weight of structure-forming constituent and approx. 62 parts by dry weight of special active substance constituent, are present per 100 parts by dry weight of filler constituent.

EXAMPLE 3

As in Example 2, with the sole difference that instead of the 1,000 grams of wheat bran and 1,000 grams of wheat straw, 2,000 grams of maize straw are employed.

EXAMPLE 4

As in Example 1, with the sole difference that instead of the 500 grams of cocoa bean shells and 500 grams of coconut shells, 500 grams of groundnut shells and 500 grams of walnut shells are employed.

EXAMPLE 5

4,250 grams of wheat chaff, 500 grams of coconut shells and 250 grams of cocoa bean shells are ground dry and suspended in 25 liters of water, and the suspension is ground wet at a temperature between 45° and 55° centigrade.

600 grams of magnesium formate, 50 grams of tartaric acid, 300 grams of potassium nitrate, 1,000 grams of paraffinurea, 300 grams of diammonium hydrogen phosphate and 10 grams of vanillylideneurea are stirred into 30 liters of water until all has dissolved. 1,500 grams of NaCMC are stirred into this solution with vigoruous stirring. The solution is stirred vigorously for approx. 5 minutes and is then left to stand for 30 minutes, being briefly stirred every 5 minutes.

The abovementioned suspension is then stirred into the solution thus produced, and a paste is formed in which 1,400 grams of glycerine, 150 grams of diethylene glycol, 1,050 grams of fruit concentrate, 600 grams of raw molasses and 105 grams of malt extract are then stirred.

The paste is consolidated by drying to give a tobacco substitute sheet.

According to this example, approx. 18 parts by dry weight of active substance constituent, approx. 12 parts by dry weight of nitrogen donor constituent, approx. 30 parts by dry weight of structure-forming constituent and approx. 51 parts by dry weight of special active substance constituent are present per 100 parts by dry weight of filler constituent.

EXAMPLE 6

2,500 grams of rice chaff and 2,500 grams of coffee bean shells are ground dry and suspended in 20 liters of water, and the suspension is ground wet at a temperature between 45° and 55° centrigrade.

600 grams of magnesium formate, 50 grams of tartaric acid, 300 grams of potassium nitrate, 1,000 grams of paraffinurea, 300 grams of diammonium hydrogen phosphate, 10 grams of vainllylideneurea, 1,500 grams of NaCMC, 1,400 grams of glycerine, 150 grams of diethylene glycol, 1,050 grams of fruit concentrate, 600 grams of raw molasses and 105 grams of malt extract are stirred into this supension.

The mixture thus produced is then kneaded in a roll mill to give a homogeneous paste which is then shaped by milling to give a sheet which is consolidated by drying.

According to this example, approx. 18 parts by dry weight of active substance constituent, approx. 12 parts by dry weight of nitrogen donor constituent, approx. 30 parts by dry weight of structure-forming constituent and approx. 51 parts by dry weight of special active substance constituent are present per 100 parts by dry weight of filler constituent.

EXAMPLE 7

As in Example 6, with the sole difference that 5,000 grams of rice chaff are employed instead of the 2,500 grams of rice chaff and 2,500 grams of coffee bean shells.

All weight quoted in the examples relate to the paste constituents with their natural water content or content of water of crystallisation.

What is claimed is:

1. A homogeneous tobacco substitute which consists of:

5,000 grams of filler consisting of: one or more of gramineous plants or shells of nuts, cocoa beans or coffee beans,
600 grams magnesium formate
50 grams tartaric acid
300 grams potassium nitrate
1,000 grams paraffinurea
300 grams diammonium hydrogen phosphate
10 grams vanillylideneurea
1,500 grams sodium carboxymethylcellulose
1,400 grams glycerine
150 grams diethylene glycol
1,050 grams fruit concentrate
600 grams raw molasses
105 grams malt extract.

2. A tobacco substitute according to claim 1, wherein the filler consists of:

4,250 grams wheat chaff
500 grams coconut shells
250 grams cocoa bean shells.

3. A tobacco substitute according to claim 1, wherein the filler consists of:

2,500 grams rice chaff and
2,500 grams coffee bean shells.

4. A tobacco substitute according to claim 1, wherein the filler consists of 5,000 grams of rice chaff.

* * * * *

UNITED STATES PATENT AND TRADEMARK OFFICE

CERTIFICATE OF CORRECTION

PATENT NO. : 3,934,594

DATED : January 27, 1976

INVENTOR(S) : Monique Beringer and Paul Buchmann

It is certified that error appears in the above-identified patent and that said Letters Patent are hereby corrected as shown below:

In the Abstract, line 13, change "1,4000" to -- 1,400 --.

Signed and Sealed this

*fourth* Day of *May 1976*

[SEAL]

*Attest:*

RUTH C. MASON
*Attesting Officer*

C. MARSHALL DANN
*Commissioner of Patents and Trademarks*